US006120097A

United States Patent [19]

Perry et al.

[11] Patent Number: 6,120,097

[45] Date of Patent: Sep. 19, 2000

[54] FLEXIBLE CHAIR WITH ADJUSTABLE SUPPORT FRAME

[76] Inventors: Charles Owen Perry, 20 Shorehaven Rd., Norwalk, Conn. 06855; Paul Owen Perry, 18 Mount Vernon St., Cambridge, Mass. 02140; Charles Christopher Perry, 3 Raymond St., Norwalk, Conn. 06854; Maria Daniela Perry, 237 Union St., Brooklyn, N.Y. 11231; Patrick Lawrence Perry, 20 Shorehaven Dr., Norwalk, Conn. 06855; Marc Carroll Perry, 231 Baltic St., Brooklyn, N.Y. 11201

[21] Appl. No.: 09/297,732

[22] PCT Filed: Nov. 7, 1997

[86] PCT No.: PCT/US97/20371

§ 371 Date: Jun. 9, 1999

§ 102(e) Date: Jun. 9, 1999

[87] PCT Pub. No.: WO98/19579

PCT Pub. Date: May 14, 1998

Related U.S. Application Data

[60] Provisional application No. 60/030,061, Nov. 7, 1996.

[51] Int. Cl.[7] ..... A47C 1/02

[52] U.S. Cl. ..... 297/325; 297/354.1; 297/354.11; 297/440.24; 297/452.13; 297/452.2; 297/229

[58] Field of Search ..... 297/452.13, 452.2, 297/325, 354.1, 354.11, 284.1, 440.24, 229, 302.6

[56] References Cited

U.S. PATENT DOCUMENTS

| | | | |
|---|---|---|---|
| 2,512,353 | 6/1950 | Magaldino et al. | 297/440.24 X |
| 2,803,291 | 8/1957 | Meyer | 297/452.13 |
| 4,522,444 | 6/1985 | Pollock | 297/440.24 X |
| 4,819,986 | 4/1989 | Markus | 297/325 |
| 4,880,273 | 11/1989 | Markus | 297/325 |
| 5,308,142 | 5/1994 | Forslund, III et al. | 297/286 |
| 5,338,094 | 8/1994 | Perry | 297/354.11 X |
| 6,050,642 | 4/2000 | Erb | 297/325 X |

*Primary Examiner*—Peter M. Cuomo
*Assistant Examiner*—Rodney B. White
*Attorney, Agent, or Firm*—Limbach & Limbach L.L.P.

[57] ABSTRACT

A flexible chair includes a seat frame having a bidirectional fabric stretched over the seat frame to define seat back and seat bottom portions. The seat frame is supported on an upper axis and a lower axis by a flexible frame. In one embodiment, the flexible frame is a substantially continuous symmetrical loop defining arm portions. The arm portions are supported by a pair of u-shaped support forks. The connection geometry between the forks and the frame may be adjusted to provide varying degrees of flex from the chair frame. In another embodiment, the flexible frame is a pair of symmetrical loops including ground supporting portions.

15 Claims, 9 Drawing Sheets

FLEXIBLE CHAIR WITH ADJUSTABLE SUPPORT FRAME

This application claims the benefit of U.S. Provisional Application 60/030,061, filed on Nov. 7, 1996.

BACKGROUND OF THE INVENTION

Many forms of flexible and reclining chairs are generally known. For example, the following patents to Charles O. Perry disclose improvements to such chairs. U.S. Pat. No. 5,009,466 discloses a reclining chair having multi-axis pivotal support. U.S. Pat. No. 5,383,712 discloses a flexible tubular chair having a unique pivotal back arrangement and well suited for high density stacking. U.S. Pat. No. 5,338,094 discloses a flexible tubular chair incorporating the pivotal back arrangement of the '712 patent but including a unique support fork that provides improved reclining for the flexible chair. U.S. Pat. No. 5,626,394 discloses an improved flexible stacking chair wherein chairs with or without arms may be stacked interchangeably.

SUMMARY OF THE INVENTION

The present invention is a chair having an adjustable, flexible supporting frame which supports a seat frame. In a preferred embodiment of the invention, a bidirectional fabric is stretched over the seat frame to form the seat back and seat bottom surfaces. An arm frame includes arm portions which are coupled at four points to the seat frame. Two of the points form an upper horizontal axis across the seat back, and the other two points form a lower horizontal axis across the front of the seat bottom.

In one form of the invention, the arm frame is supported from below by a support fork assembly. The coupling of the support fork assembly to the arm frame may be varied in a number of ways to provide adjustable flexure to the chair.

In another form of the invention, the arm frame is self-supporting with a ground supporting member as part of a stackable frame.

A better understanding of the features and advantages of the present invention will be obtained by reference to the following detailed description of the invention and accompanying drawings which set forth an illustrative embodiment in which the principles of the invention are utilized.

DETAILED DESCRIPTION OF THE INVENTION

Figure 1:
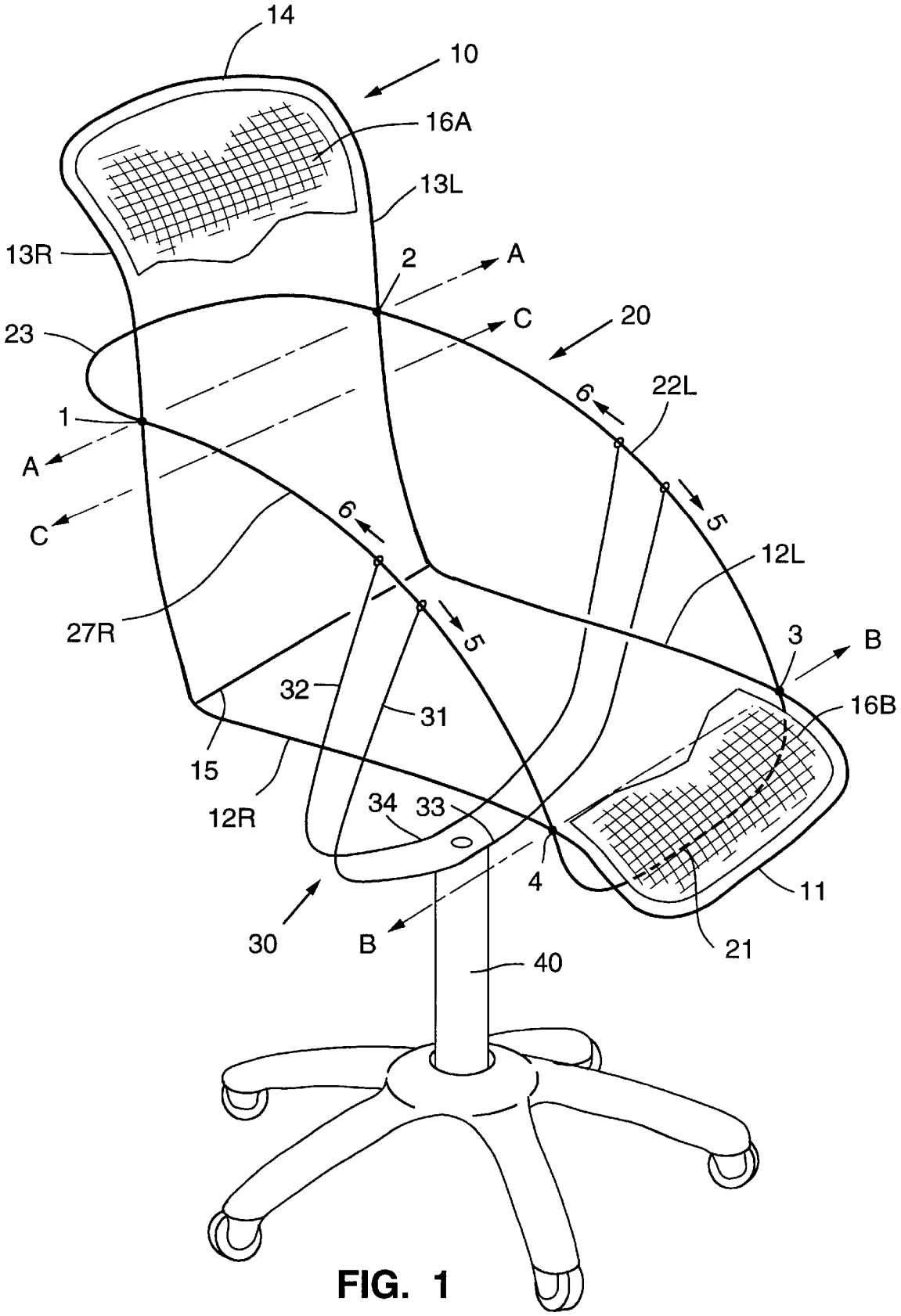
FIG. 1 is a simplified schematic representation a chair according to the present invention.

A chair in accord with the present invention is shown in simplified schematic form in FIG. 1. The chair includes a first frame 10 which is a substantially continuous loop extending symmetrically from a front portion 11 rearward along side portions 12L and 12R then upward along back portions 13L and 13R then along top portion 14. A practical construction of the chair will include a connecting rod 15 attached between the left and right side 12 and/or back 13 portions in the butt position of the chair substantially as shown. The connecting rod 15 is preferably affixed after a bidirectional fabric 16 is stretched across the first frame 10 to form seat back portion 16A and seat bottom portion 16B, as will be described in more detail shortly.

A second frame 20 is also a substantially continuous loop extending symmetrically from front portion 21 upwardly and rearwardly along arm portions 22L and 22R then along back portion 23. The second frame 20 is coupled to the first frame 10 at four points numbered 1, 2, 3, 4 thereby forming two horizontal axes A and B. Axis A is formed by connecting the rear of arm portions 22L and 22R to back portions 13L and 13R, respectively, at a selected points 1 and 2 near the middle of the back portion 16A. Axis B is formed by connecting the front of arm portions 22L and 22R to side portions 12L and 12R, respectively, at a selected points 3 and 4 near the front of seat portion 16B. A third axis C is created for additional flexure of the back in accord with a preferred embodiment, as further described below.

A support assembly 30 includes a pair of u-shaped forks 31 and 32 which extend symmetrically from their bight portions 33 and 34, respectively, upwardly to support arm portions 22L and 22R. The support assembly 30 is supported from below, for example by a vertical post 40 coupled to the bight portions 33, 34.

The basic structure of the support assembly 30 comprising support forks 31 and 32 is substantially disclosed in U.S. Pat. No. 5,338,094, which is expressly incorporated by reference herein. The orientation of the support forks 31, 32 relative to each other and to the second frame 20 is affected by several variables, each of which may be adjusted according to customer preference to provide varying degrees of movement and resistance in the chair.

Generally, the front fork 31 is in tension, the rear fork 32 is in compression, and both forks work together in torsion. However, this is affected in part by the coupling between the support forks 31, 32 and the arm portions 22L, 22R. For example, the coupling point between the support forks 31, 32 and the arm portions 22L, 22R may be moved forward as shown by arrow 5 to provide a softer flex or rearward as shown by arrow 6 to provide a stiffer flex to the chair. Likewise, the amount of separation between the front fork 31 and the rear fork 32 may be increased to provide more stiffness or decreased to provide more softness to the chair. Changing the relative length of the support forks 31, 32 affects the angle of the first frame 10; a longer rear fork 32 will tilt the chair forward and vice versa. Certain other variations of the fork coupling and adjustment will be described later with reference to FIGS. 8–11.

It is preferred that frame components such as the frames 10, 20 and support forks 31, 32 be made from solid metal rod or tubular steel, as described below, but the invention is not intended to be limited in this regard.

Figure 2:
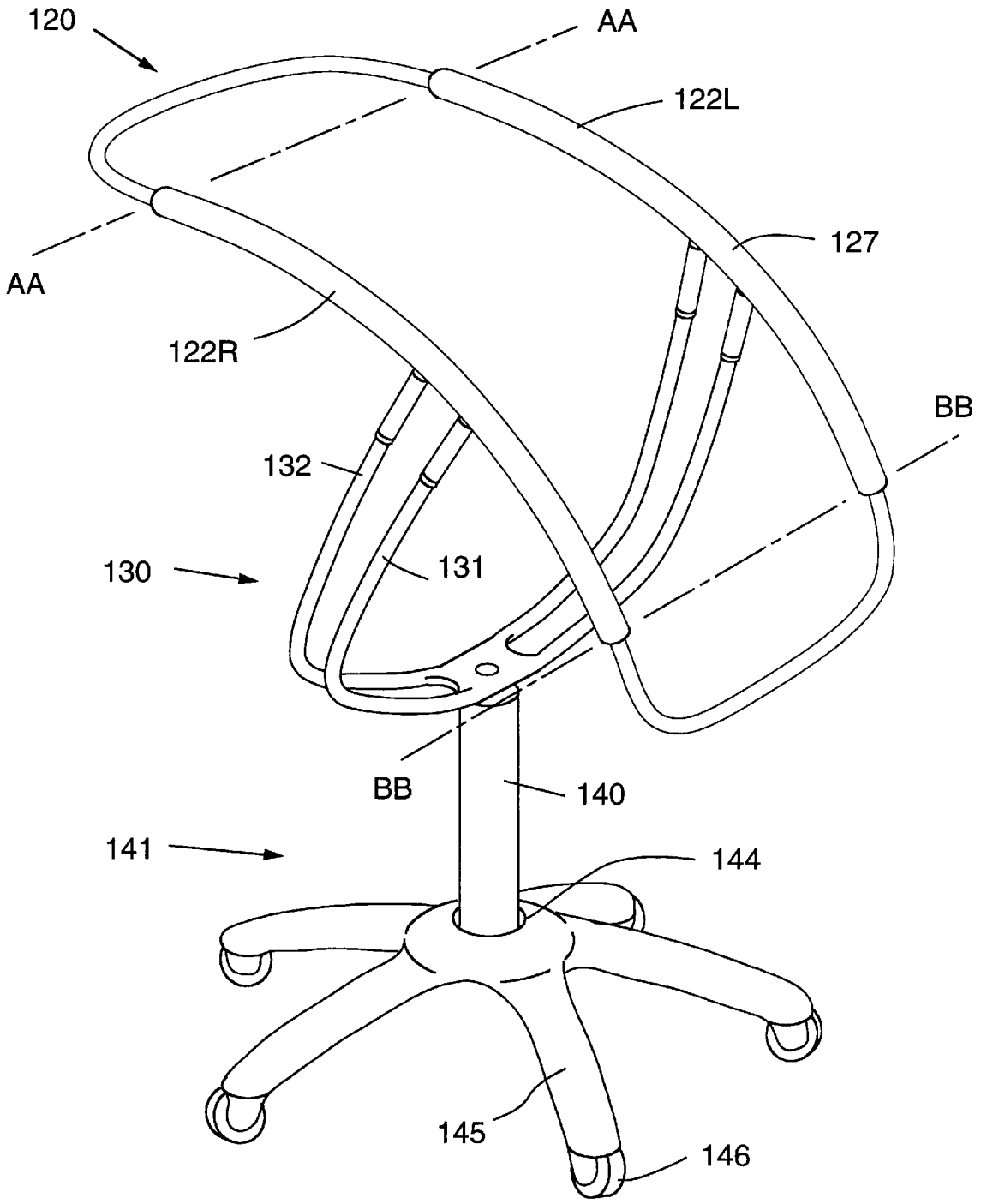
FIG. 2 is a front perspective view of the arm and fork portions of the chair.

Referring to FIG. 2, the preferred embodiment of the invention will now be described. A vertical post 140 extends upwardly from a base assembly 141 to support the fork assembly 130. The fork assembly 130 in turn supports the arm assembly 120. The arm assembly 120 in turn supports a seat frame assembly 110 (shown in FIG. 5) at axes AA and BB.

The base assembly 141 may be fully conventional, such as a swivel base apparatus which is adapted for resting on the floor and providing a central post 140 on which the chair may be supported for swiveling. For example, the illustrated embodiment includes a central hub 144 supporting the post 140 and arms 145 extending radially from the hub. The arms 145 are provided with suitable hardware (not shown) for receiving snap-in type wheels 146 or the like in a well-known manner.

The vertical post 140 extends upwardly from the central hub 144 to support the fork assembly 130 in a manner which permits free rotation of the fork assembly about the base 140 in a conventional manner.

The base assembly 141 could take any number of well known forms having a vertical post 140 for receiving and supporting the fork assembly 130, or may consist solely of the post 140, which may be fixed in place to support the fork assembly 130. For example, such a configuration would be well suited in an auditorium or a stadium, where posts could be fixed in concrete rows, or on beams, and chairs mounted on the posts.

The swivel apparatus 141 may be made from plastic or metal, but the hub 144 and vertical post 140 will preferably be made from suitable metal due to the high stress associated with these parts.

The arm frame 120 provides the arm portions 122L, 122R of the chair in a downward extending loop which is supported on the fork assembly 130.

Preferably, the arm frame 120 is made from five-eighths inch tubular steel, although other suitable materials may also be used. A soft rubberized coating 127 or the like may be applied to both arm portions 122L, 122R to provide a more comfortable arm surface for the user.

Figure 3:
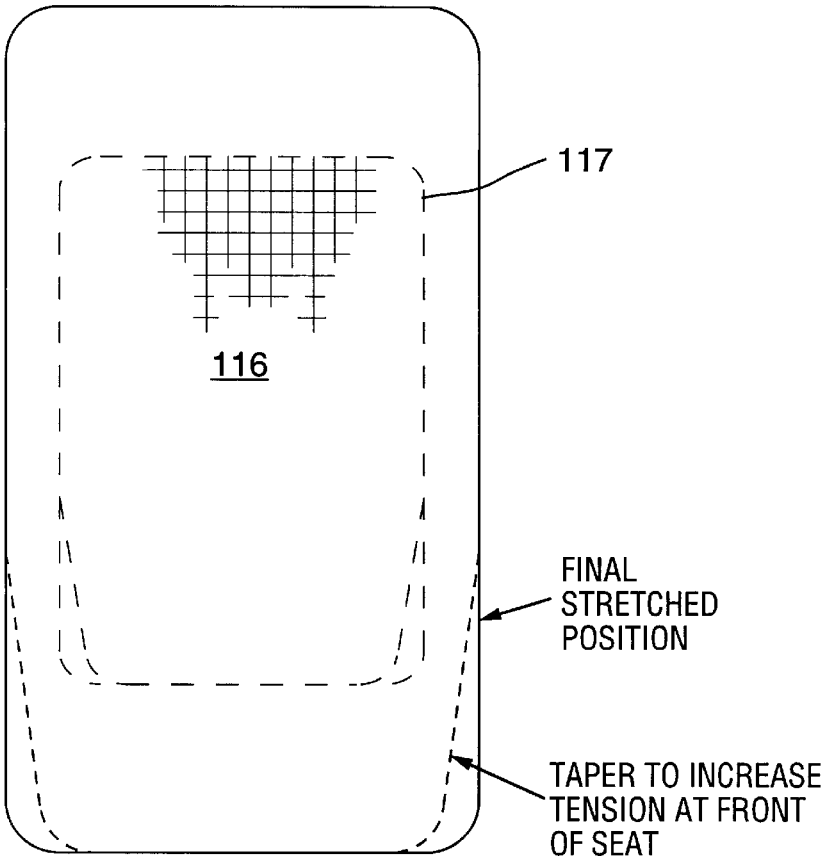
FIG. 3 is a front plan view of the fabric pattern for the bidirectional material used to cover the seat frame.
Figure 4:
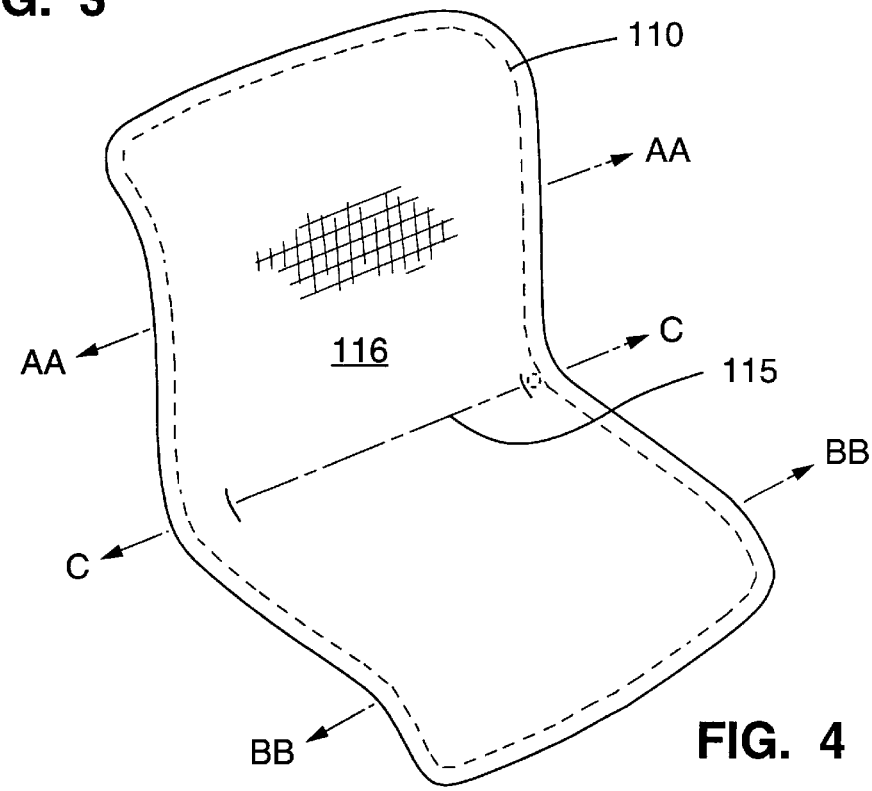
FIG. 4 is a front perspective view of the bidirectional fabric as stretched over the completed seat frame.

A bidirectional mesh fabric cover 116 is shown as a pattern in FIG. 3, and is shown stretched across the seat frame 110 in FIG. 4 to provide a flexible yet comfortable seating surface.

The fabric cover 116 is preferably a single piece of bidirectional mesh fabric, such as high density (e.g. 25 threads per inch) two-way stretch woven cloth. The fabric may be cut to appropriate size, then the seat frame 110 inserted as components into openings or pockets provided in the sewn fabric pattern and completed as described below. Alternatively, the fabric may be stretched over the completed seat frame and heated to shrink the fabric to the frame using well known techniques.

Figure 5:
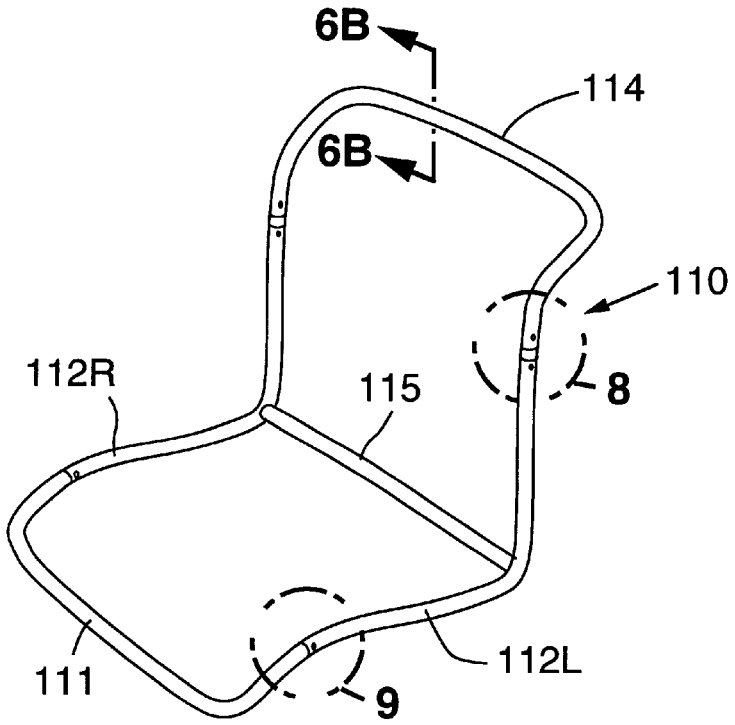
FIG. 5 is a front perspective view of the seat frame.
Figure 6A:
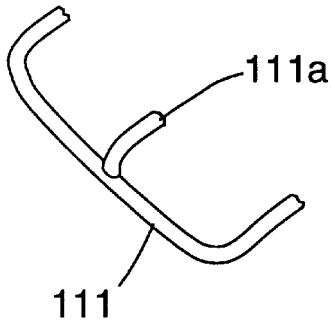
FIG. 6A is a front perspective view of the front section of the seat frame.
Figure 6B:
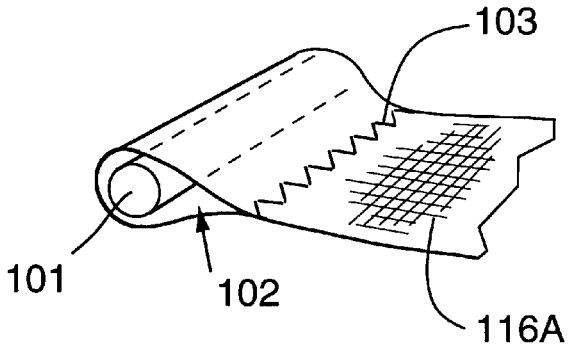
FIG. 6B is a sectional diagram showing the detail of section 6B—6B on FIG. 5.

Referring to FIG. 5, the seat frame 110 is preferably constructed by assembling front section 111, mid-sections 112L and 112R, and top section 114, after insertion of these sections into pockets sewn into the fabric cover. These sections are preferably five-eighths inch steel tube 101, formed or bent to shape. As shown in FIG. 6A, front section 111 preferably includes a support bar 111*a* attached to the middle of section 111, for example, by weldment, to provide additional support against sagging of the fabric cover 116. Support bar 111*a* can be a smaller diameter steel, for example, three-eighths inch. As shown in FIG. 6B, each section of tube 101 is inserted into a corresponding pocket 102 formed in the fabric cover 116A, for example, by wrapping the fabric and sewing on seam 103, as shown. The location of seam 103 is left to design preference, but if left out from the end about five or six inches, then pockets are formed which are suitable to accommodate foam inserts, or support bar 111*a,* for example.

Figure 7:
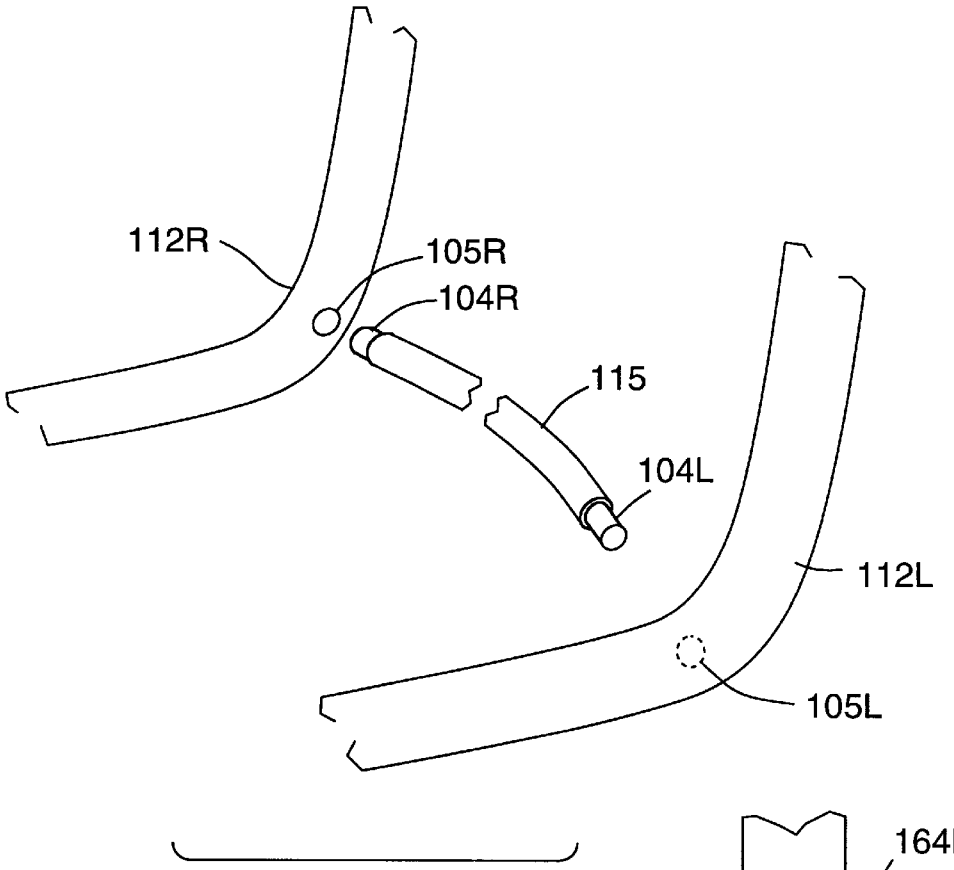
FIG. 7 is an exploded perspective view of the seat frame showing the connecting rod detail from FIG. 5.

A connecting rod 115 is preferably attached by inserting plug-ends 104L, 104R into corresponding holes 105L, 105R in the mid-sections 112 after the bidirectional fabric 116 has been attached, as shown in FIG. 7.

Figure 8:
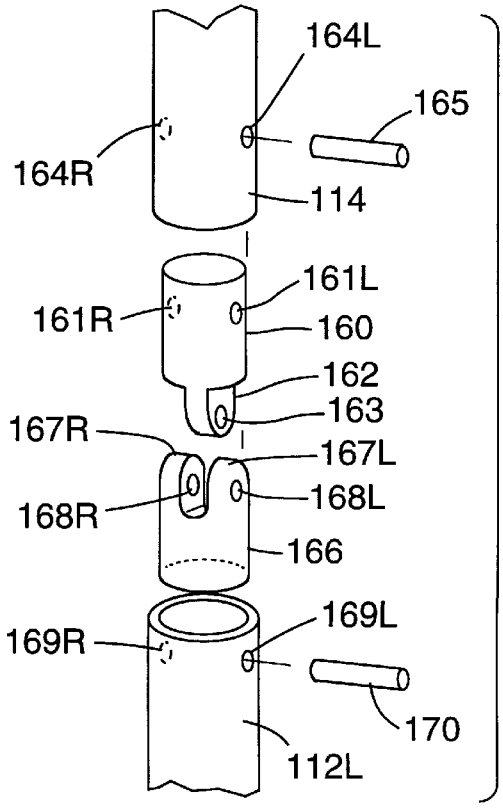
FIG. 8 is an exploded perspective view showing additional detail from FIG. 5 of the connection between the top portion and the side portions of the seat frame.

The top section 114 is coupled on each side in like manner to mid-sections 112L and 112R, as shown in FIG. 8 for the left side section 112L. A first hinge part 160 is inserted into the top section 114. The first hinge part 160 has a pair of openings 161L, 161R, disposed in opposition with each other, and a tab 162 extending downwardly with a cylindrical opening 163 therein which is substantially parallel with the cylinder formed by the openings 161L and 161R. The hinge part 160 is inserted into the hollow interior of top section 114 such that openings 161L, 161R, are aligned with corresponding openings 164L, 164R, in the top section 114. A hinge pin 165 is then fit through the corresponding openings 164L, 161L, 161R, 164R and secured via weldment, screw or other suitable means.

A second hinge part 166 is inserted into the mid-section 112L. The second hinge part 166 includes u-shaped arms 167L, 167R which include respective openings 168L, 168R disposed in opposition with each other. The hinge part 166 is inserted into the hollow interior of mid-section 112L such that openings 168L, 168R are aligned with corresponding openings 169L, 169R, in the mid-section 112L. The tab 162 of the first hinge pin 160 is then fit in between the u-shaped arm 167L, 167R of the second hinge pin 166 such that opening 163 is aligned with corresponding openings in the second hinge pin and the mid-section 112L. A hinge pin 170 is then fit through the corresponding openings 169L, 168L, 163, 168R, 169R and secured via weldment, screw or other suitable means. The hinge portions 160, 166 provide a rearward pivoting action of about 30 degrees relative to the frame, which further enhances the flexibility of the chair.

Figure 9:
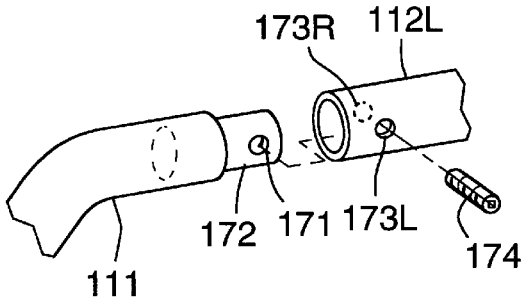
FIG. 9 is an exploded perspective view showing additional detail from FIG. 5 of the connection between the front portion and the side portions of the seat frame.

The coupling of the front portion 111 to the mid-section 112L is shown in FIG. 9. It consists of a simple plug 172 inserted into the hollow interior of the front section 111 and affixed via weldment or the like and extending therefrom. The plug 172 has an opening 171 in the extended portion which is inserted into the mid-section 112L and aligned with corresponding openings 173L, 173R. Preferably, opening 171 is threaded to receive a threaded bolt 174 or the like for rigidly securing the two frame sections together.

As already mentioned, the fork assembly 120 is substantially as described in U.S. Pat. No. 5,338,094. However, several variations on the coupling of the forks to the arms will now be described.

Figure 10:
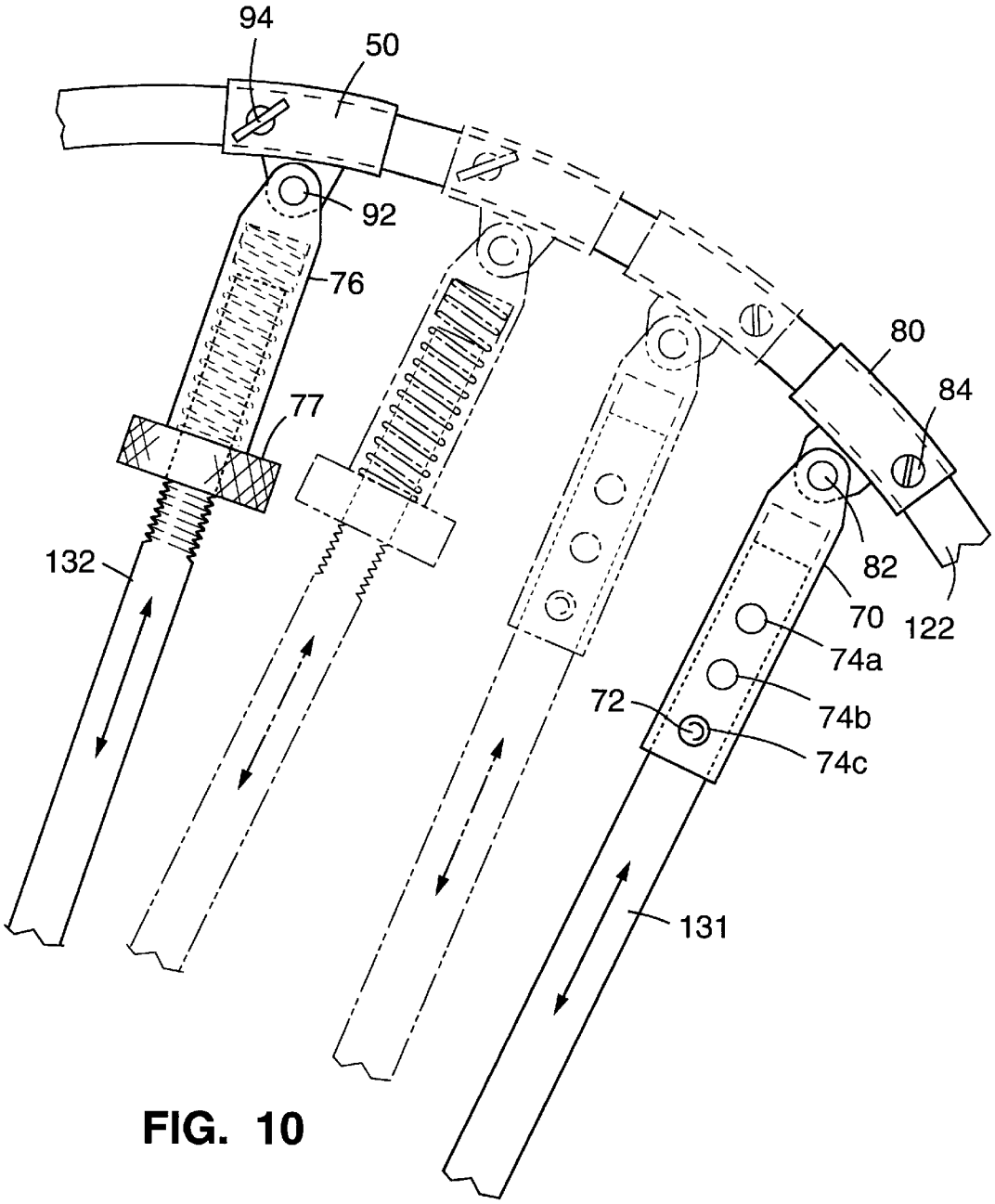
FIG. 10 is a side perspective view showing the attachment of the fork assembly to the arm portion.
Figure 11:
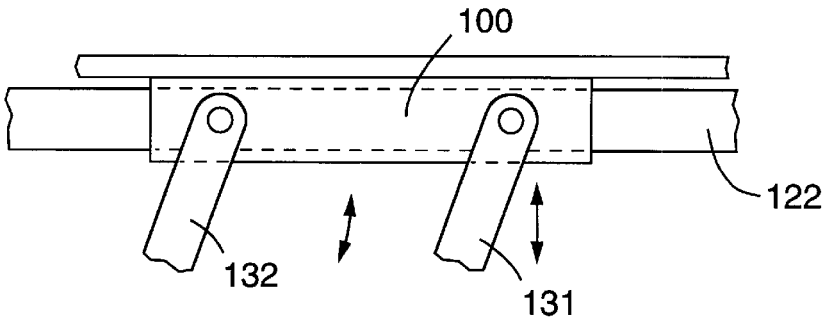
FIG. 11 is a side perspective view showing an alternative attachment of the fork assembly to the arm portion.

Referring now to FIG. 10, the preferred method of attaching the fork structure 130 to the arm frame 120 is shown. Two positions for each fork are shown, one in solid line and the other in dashed line, to illustrate how the position of each fork may be changed. In this embodiment, the front fork 131 has a sleeve 70 which fits over the top of the vertical portion of the fork. The sleeve 70 is coupled to the vertical portion of the fork 131, for example, by a depressible ball catch mechanism 72. The end of the vertical portion of fork 131 preferably has several holes 74*a,* 74*b,* 74*c,* etc. cut therein to allow for varying the vertical length of the fork 131 as well as the position at which the fork is coupled to arm 122.

The top of sleeve 70 is coupled to a sliding sleeve 80 which is positioned over the arm 122, for example, by a pin 82 through both sleeves. The sliding sleeve 80 on arm 122 is capable of sliding over the arm to different positions and being fixed in position by a set screw 84, for example.

The rear fork 132 is threaded at the top of the vertical portion. A sleeve 76 includes a threaded ring nut 77 which mates with the threads of the rear fork and can be turned for providing vertical adjustment, i.e. a change in the vertical length of the rear fork 132. The sleeve 76 is coupled to a sliding sleeve 90 on arm 122 via pin 92 in the same manner as previously described with reference to the front fork. However, a thumb screw 94 is used instead of a set screw so that the position at which the sleeve 90 is coupled to the arm 122 may be easily changed by the user. Any combination of factory setting or user adjustment may be provided.

Another method of attaching the forks to the frame is shown in FIG. 10, wherein a single sleeve 100 is coupled to arm 122, and both the front fork 131 and rear fork 132 are coupled to the single sleeve 100.

Numerous other methods could be conceived for implementing the connection of the forks to the frame and for providing varying degrees of adjustment for the position and length of one or both forks without departing from the scope of this invention.

Figure 12B:
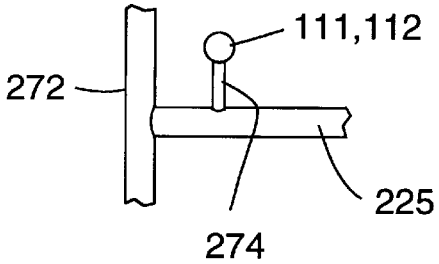
FIG. 12B is a detailed view of section 12B—12B in FIG. 12A.
Figure 12A:
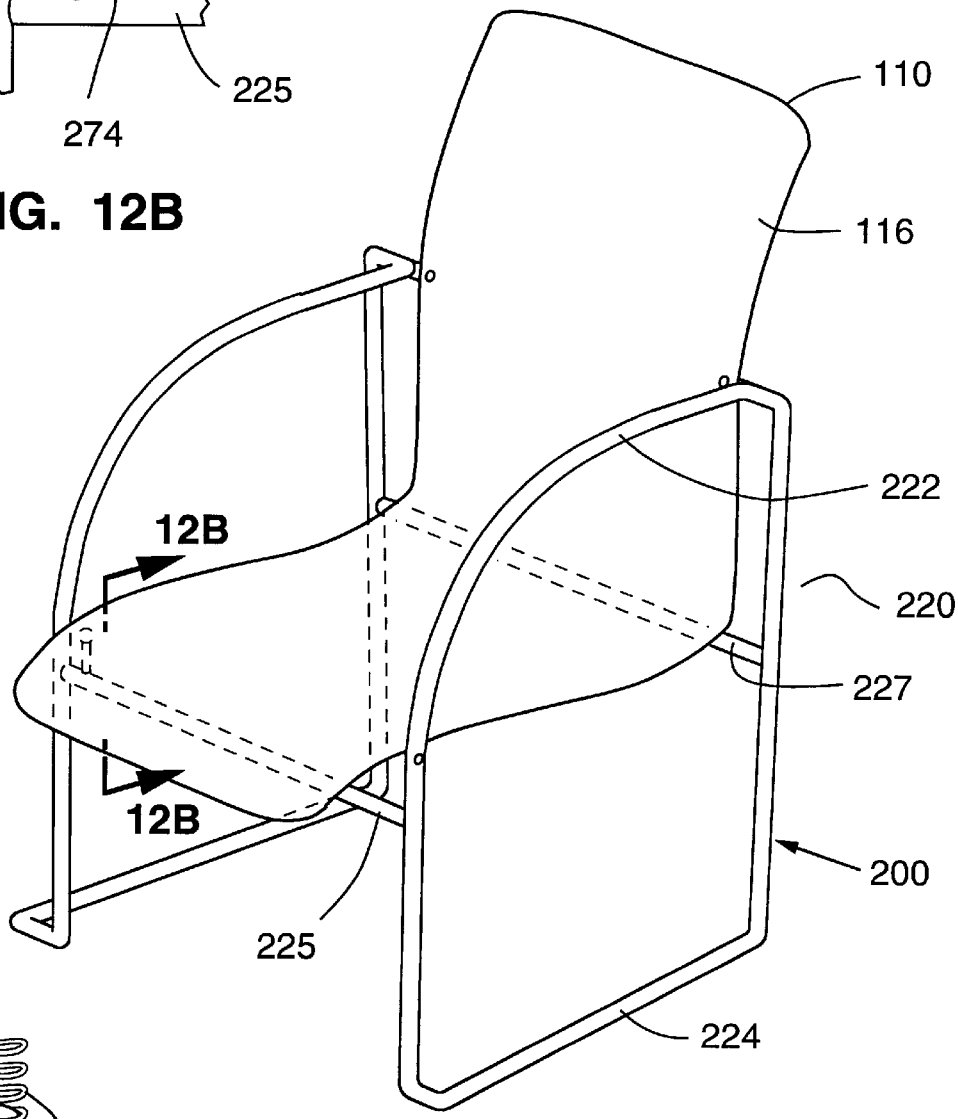
FIG. 12A is a front perspective view of an alternative embodiment of the invention.

Referring now to FIG. 12A, another embodiment of the invention is illustrated. The chair 200 includes a seat frame 110 with bidirectional fabric cover 116 as previously described. However, in this embodiment, a pair of arm frames 220 are provided, wherein each arm frame is a freestanding continuous loop which provides an arm portion 222 and ground support portion 224. It will be noted that the ground support portions 224 are offset to the outside of the arm portions 222, to facilitate stacking of chairs. In addition, a front support bar 225 is coupled between the arm frames 220 just below the front portion of the seat frame 110 as shown, and a rear support bar 227 is coupled between the arm frames at the rear of the seat frame, to provide additional strength and stability to the chair.

Figure 12C:
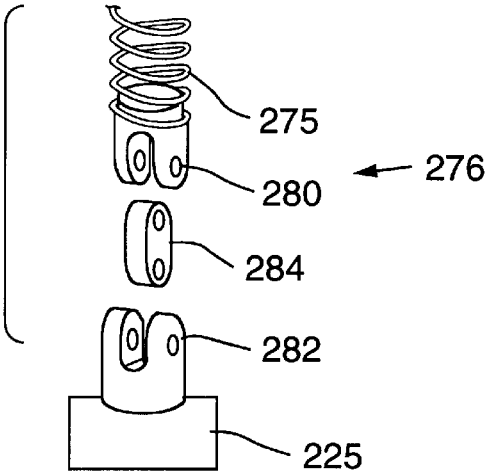
FIG. 12C is a perspective view of a hinge connection used in the embodiment of FIG. 12A.

Advantageously, the support bar 225 can include a projection 274 near each side of frame 220 that inserts into openings 171, 173 in sections 111, 112, respectively (see FIG. 9). Alternatively, the projection 274 can be made from a resilient or flexible material, or it could be a spring 275 as shown in FIG. 12C. By providing some flexibility in this connection, the chair is moved back and forth when tilted and the seat is pivoted forward and upward. Additionally, it is conceivable that a spring would be rigidly connected into sections 111/112, but connected by a hinge 276 to the support bar 225, as shown in FIG. 12C. The hinge 276 could include a first portion 280 fixed to the spring 275 and a second portion 282 fixed to the support bar 225. A hinge link 284 couples the two hinge portions 280, 282 together to provide rotation.

Connection of the seat frame 110 to the arm frames 220 is as previously described.

Figure 13:
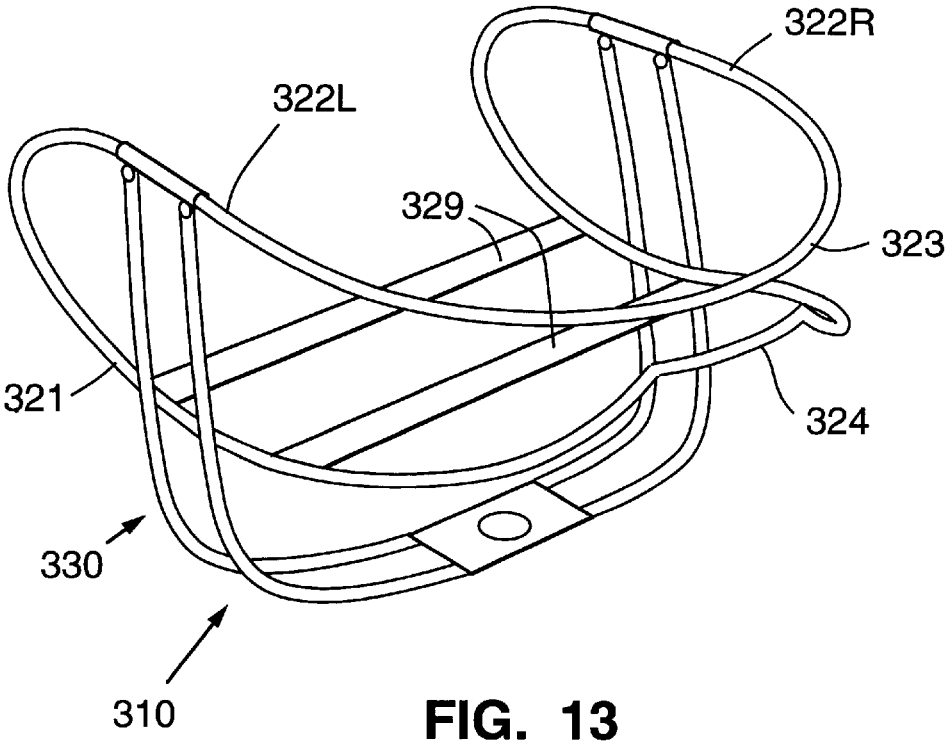
FIG. 13 is a front perspective view of an alternative embodiment of the invention.

Another embodiment is shown in FIG. 13, where chair frame 310 includes arm portions 322L and 322R disposed symmetrically at the side of the chair frame. Preferably, the chair frame is a substantially continuous loop beginning from the upper back portion 323 then along arm portions 322 then downwardly and rearwardly along portions 321 then to the lower back portion 324. Straps 329 are affixed between portions 321 to support a seat bottom (not shown). This type of frame is substantially disclosed in prior U.S. Pat. No. 5,383,712, which is expressly incorporated herein by reference. The frame 310 is supported by support forks 330 in the manner described above.

Figure 14:
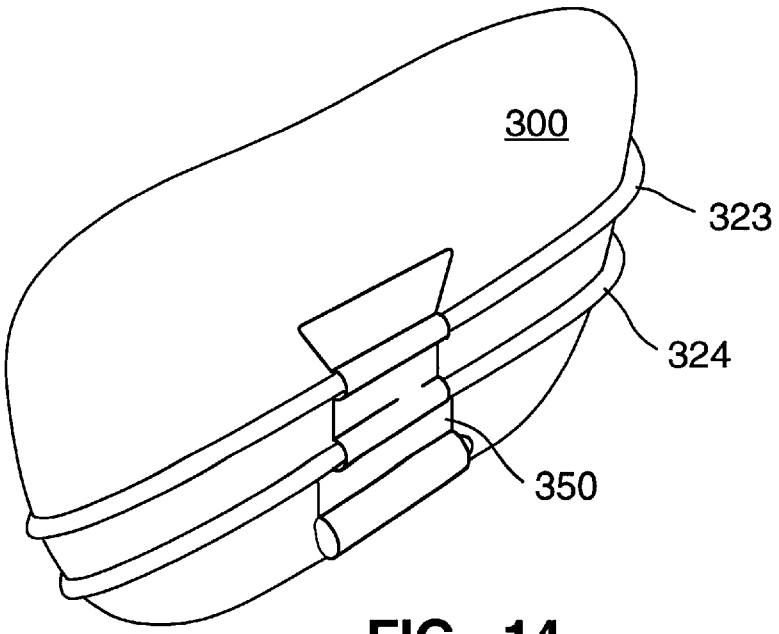
FIG. 14 is a perspective view of a portion of the connection of the frame to the seat back.
Figure 15:
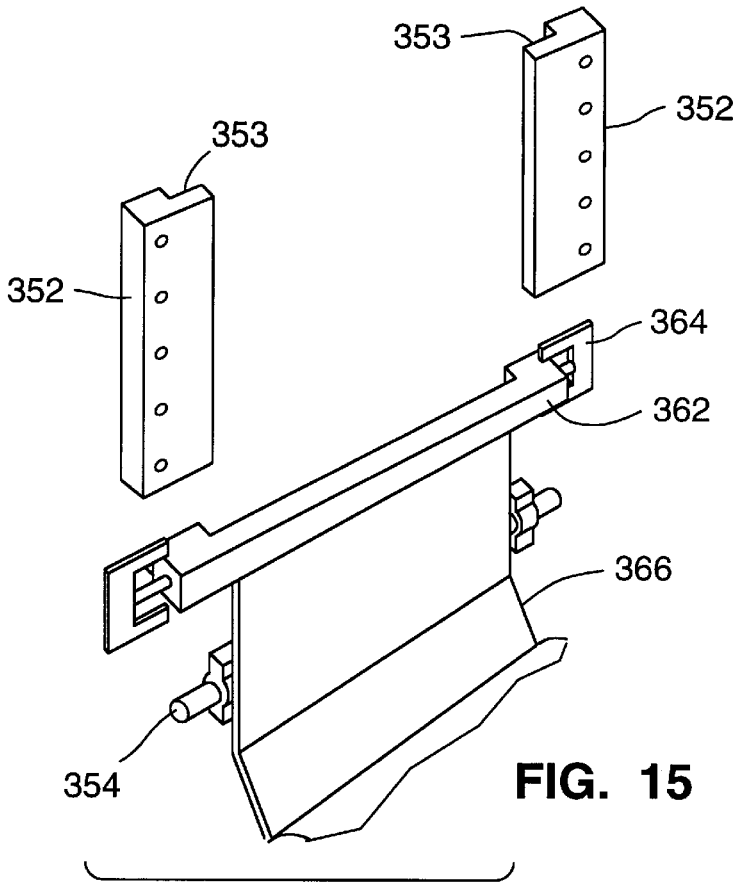
FIG. 15 is a perspective view of a portion of the connection shown in FIG. 14.
Figure 16:
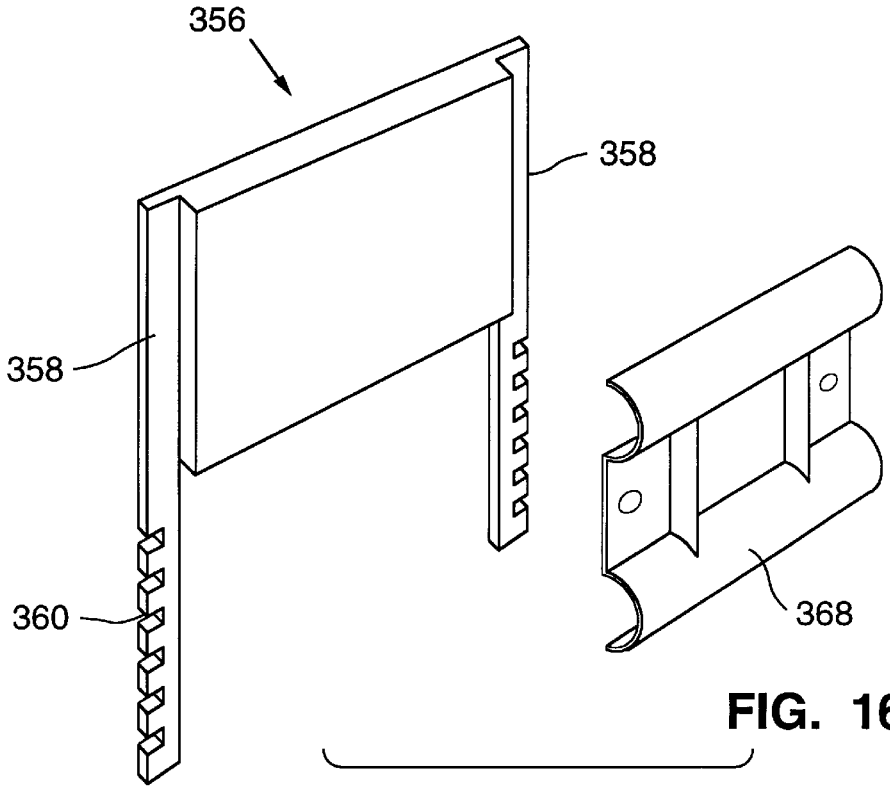
FIG. 16 is a perspective view of a portion of the connection shown in FIG. 14.

In addition to adjustable fork connections, as previously described, the way that a seat back may be connected to the frame 310 can also provide some adjustment. As shown in FIGS. 14–16, the frame has an upper bar 323 and a lower bar 324 which extend continuously through a bracket 350 affixed to the back of the seat back 300 The bracket 120 includes a pair of glide plates 352 and a fulcrum 354 that are rigidly affixed to the seat back. A slider bracket 356 includes slide plates 358 which mate with corresponding grooves 353 in the glide plates 352. The bottom portion of each slide plate 358 includes outwardly extending ratchet teeth 360. A shear plate 362 has shear brackets 364 on each side thereof designed to mate with the ratchet teeth 360 on the slide plates 358. The shear plate 362 is affixed to the fulcrum 354 and includes a lever portion 366 on the bottom portion of the shear plate. Upon depressing the lever 366, the shear bracket 364 is disengaged from the ratchet teeth 360 such that the slider bracket 356 may be moved up or down to another position. A frame bracket 368 holds the upper bar 323 and lower bar 324 rigidly against the slider bracket 356.

The invention is not intended to be limited by the specifics of the above-described embodiment, but rather defined by the accompanying claims.

We claim:

1. In a flexible chair having a seat frame forming a substantially continuous loop symmetrically about the chair beginning from a upper bearing portion then forwardly along arm portions then downwardly then rearwardly along lateral side portions to a lower bearing portion, a seat back pivotally attached to the seat frame at both the upper bearing portion and the lower bearing portion, a seat bottom attached between the lateral side portions of the seat frame, and a support frame comprising a pair of parallel support members formed generally into a u-shape and connected to each other at a bottom of the u-shape, each of the support members being pivotally attached at each end thereof to the seat frame at respective arm portions, the improvement comprising:

upper and lower generally u-shaped frames pivotally connected together at the lower bearing portion with the upper u-shaped frame defining the seat back and the lower u-shaped frame defining the seat bottom and the upper and lower u-shaped frames defining a bounded area and a bidirectional fabric stretched across the bounded area.

2. The flexible chair of claim 1, wherein the seat back is pivotally attached to the seat frame at both the upper bearing portion and the lower bearing portion by seat back adjustment means for adjusting the relative position of attachment.

3. The flexible chair of claim 2, wherein the seat back adjustment means includes a bracket for rigidly holding the upper bearing portion and the lower bearing portion, and means for moving the bracket up and down.

4. The flexible chair of claim 3, wherein the seat back adjustment means includes a bracket for rigidly holding the upper bearing portion and the lower bearing portion, and means for moving the bracket up and down.

5. A flexible chair, comprising:

a support frame including a u-shaped arm support, a first closed loop defining a pair of arms each coupled to the arm support, a second closed loop defining a bounded area and nested within the first closed loop, wherein the bounded area includes a seat back portion in a vertical orientation and a seat bottom portion in a horizontal orientation, and wherein the second closed loop is pivotally connected to the first closed loop at a first two points defining a first pivotal axis in a middle region of the seat back portion, and wherein the second closed loop is pivotally connected to the first closed loop at a second two points defining a second pivotal axis in a front region of the seat bottom portion, and a bidirectional fabric stretched across the bounded area.

6. A flexible chair as in claim 5, wherein the second closed loop further includes a third two points defining a third pivotal axis and located on the seat back portion below the first pivotal axis.

7. A flexible chair as in claim 5, wherein the coupling between the u-shaped arm support and each arm is adjustable.

8. A flexible chair, comprising:

a pair of first closed loops symmetrically disposed and each defining an arm portion and a ground supporting portion, a second closed loop defining a bounded area and nested between the first closed loops, wherein the bounded area includes a seat back portion in a vertical orientation and a seat bottom portion in a horizontal orientation, and wherein the second closed loop is pivotally connected to the first closed loops at a first two points defining a first pivotal axis in a middle region of the seat back portion, and wherein the second closed loop is pivotally connected to the first closed loops at a second two points defining a second pivotal axis in a front region of the seat bottom portion, and a seat cover covering the bounded area.

9. A flexible chair as in claim 8, wherein the ground supporting portion is offset from the arm portion to facilitate stacking.

10. A flexible chair as in claim 8, further comprising a first support bar coupled between the first closed loops below the first pivotal axis.

11. A flexible chair as in claim 10, wherein the first support bar includes a pair of projections each located proximate to a corresponding one of the first closed loops and extending upwardly to couple with the second closed loop.

12. A flexible chair as in claim 11, wherein the projections are flexible.

13. A flexible chair, comprising:

a first closed loop defining a bounded area including a seat back portion and a seat bottom portion orientation, a flexible support frame pivotally coupled to support the closed loop at a first horizontal axis located in the seat back portion and at a second horizontal axis located in the seat bottom portion, and a bidirectional fabric covering the bounded area.

14. A flexible chair as in claim 13, wherein the flexible support frame comprises a second closed loop defining a pair of arms and a u-shaped arm support coupled to each arm, wherein the first closed loop is nested within the second closed loop.

15. A flexible chair as in claim 13, wherein the flexible support frame comprises a pair of closed loops symmetrically disposed and each defining an arm portion and a ground supporting portion.

* * * * *